US006123254A

United States Patent [19]

Dupuis

[11] Patent Number: 6,123,254

[45] Date of Patent: Sep. 26, 2000

[54] GOLF BAG SHIPPING CASE

[76] Inventor: Jane E. Dupuis, 6576 Sweet Fern, Columbia, Md. 21045

[21] Appl. No.: 09/290,892

[22] Filed: Apr. 14, 1999

[51] Int. Cl.[7] ..... B65D 5/00

[52] U.S. Cl. ..... 229/115; 229/138; 229/140; 229/117.18

[58] Field of Search ..... 229/115, 117.18, 229/137, 148, 138, 140; 266/315.3

[56] References Cited

U.S. PATENT DOCUMENTS

| | | | |
|---|---|---|---|
| 218,479 | 8/1879 | Bolchini . | |
| D. 252,774 | 8/1979 | Gregory . | |
| D. 282,303 | 1/1986 | Jessen . | |
| D. 312,531 | 12/1990 | Sherer et al. . | |
| D. 350,026 | 8/1994 | Lin . | |
| D. 394,950 | 6/1998 | Kite . | |
| 443,397 | 12/1890 | Mack . | |
| 587,967 | 8/1897 | Howe et al. | 229/115 |
| 695,557 | 3/1902 | Houghland . | |
| 1,457,770 | 6/1923 | Dodge | 229/115 |
| 1,897,143 | 2/1933 | Powell . | |
| 1,974,674 | 9/1934 | Halladay et al. . | |
| 2,227,341 | 12/1940 | Greenwood . | |
| 2,289,619 | 7/1942 | Anderson, Jr. . | |
| 2,349,589 | 5/1944 | Harrington | 229/115 |
| 2,421,748 | 6/1947 | Fink | 229/115 |
| 2,604,255 | 7/1952 | Welshenbach . | |
| 2,645,353 | 7/1953 | Anderson, Jr. . | |
| 2,996,234 | 8/1961 | Wheeler | 229/115 |
| 3,550,834 | 12/1970 | McCall . | |
| 3,653,576 | 4/1972 | Stranicky . | |
| 4,281,788 | 8/1981 | Robinson . | |
| 5,178,396 | 1/1993 | Lyon et al. . | |
| 5,495,983 | 3/1996 | Lelek . | |

*Primary Examiner*—Stephen P. Garbe
*Assistant Examiner*—Tri M. Mai
*Attorney, Agent, or Firm*—McGuireWoods, LLP

[57] ABSTRACT

A single corrugated cardboard blank which when folded forms a hollow elongated prism. The carrying case includes side panels connected at side fold lines to opposing sides of a central panel, and upper and lower panels are connected by fold lines to opposing ends of the central panel and the side panels. The upper and lower panels form a substantially flat base when the blank is in the folded position. A side flap is further connected by a side fold line to one of the side panels. The side flap includes projecting tabs which communicate with slits in the central panel when the blank is folded. Also, the side flap is substantially a same shape as the side panels and the central panel, but may also be slightly wider than the side panels.

21 Claims, 3 Drawing Sheets

GOLF BAG SHIPPING CASE

BACKGROUND OF THE INVENTION

1. Field of the Invention

The present invention generally relates to an article carrier and, more particularly, to a case for carrying golf clubs and golf bags and other golf equipment.

2. Description of the Related Art

In recent years, the popularity of golf has increased tremendously. This increase in popularity of golf can be seen by the rise in sales of golf equipment, such as golf clubs and golf bags, as well as increased waiting times to "tee off" at local area golf courses.

Due to the renewed interest and popularity in the game of golf, it is not uncommon to now see golfers taking vacations and traveling long distances in order to play golf on golf courses throughout the world. However, instead of renting golf equipment, such as golf clubs and golf bags, many golfers prefer using their own golf equipment when playing on these far away golf courses.

In order for golfers to use their own equipment when playing on these far away golf courses, they must pack the golf equipment in a secure manner so as to avoid damaging or losing such equipment. This may consist of simply packing their golf equipment in the golf bag itself, and placing a cover over the opening of the golf bag, or buying specialty equipment designed specifically for storing golf equipment during travel. However, it is a common occurrence for golf clubs and other equipment to be damaged or lost during travel using the currently known specialty equipment designed for storing golf equipment during travel. This is especially true when the golf equipment is stored with luggage or other heavy objects in a luggage compartment of an airplane during air flights to these various golf courses.

Lost and damaged golf equipment, of course, has led to an increased demand for golf storage cases which both protect one's golf equipment while ensuring that the golf equipment will not be lost during travel. Many of these currently designed golf cases are shells constructed from metal or rigid plastic and are shaped to accommodate a golf bag with golf clubs stored therein. Generally, these types of cases comprise two mating shells hinged together along a side so that the case may be opened to receive the golf equipment therein. Some examples of these types of cases are shown in U.S. Design Patent 252,774, U.S. Design Patent 282,303, U.S. Design Patent 350,026, and U.S. Design Patent 394,950.

Still other currently designed cases are tubular in design and incorporate a cap or the like through which a golf bag with golf clubs can be inserted or removed from the case. An example of this type of case is U.S. Design Patent 312,531. While these cases store golf clubs and golf bags and prevent loss thereof, these types of protective cases are generally expensive and are very heavy and cumbersome. Also, due to the design of these golf cases, luggage or other heavy objects can be placed on these cases during travel, thus potentially damaging the golf clubs, golf bag and other golf equipment.

The popularity of golf has also increased the sale of golf equipment. Accordingly, an increased number of golf bags and golf clubs or a combination thereof are now being transported via mail or other shipping methods. In these instances, there is a potential for individual golf clubs to be separated from the remaining golf clubs, or even to be lost or damaged during transport to their destination.

It is impractical, of course, to transport the golf equipment in the golf cases mentioned above, simply due to the cost involved in using these golf cases for shipping purposes. Thus, in order to aid in protecting golf clubs and other equipment during transport, various types of cardboard shipping and display boxes have been developed. Examples of these various types of shipping and display boxes are shown in U.S. Pat. No. 5,495,983, U.S. Pat. No. 2,645,353, U.S. Pat. No. 2,604,255, U.S. Pat. No. 2,289,619, and U.S. Pat. No. 1,974,674. However, the above examples of golf club shipping boxes do not make provisions for the inclusion of a golf bag, but rather only the golf clubs.

There is thus a current need for an inexpensive golf case which provides protection for a golf bag and golf clubs against damage during travel or transport. There is also a need for an inexpensive golf case which prevents the loss or separation of golf clubs during travel or transport. There is still a further need for a golf case which can accommodate both the golf bag and golf clubs, and other equipment.

SUMMARY OF THE INVENTION

It is an object of the present invention to provide a golf bag shipping case for protecting a golf bag with golf clubs stored therein during travel or shipping.

It is another object of the present invention to provide a golf bag shipping case for preventing the loss or separation of golf clubs during travel or shipping.

It is still another object of the present invention to provide a golf bag case shipping which is shaped so that other objects cannot be stacked thereon during travel or shipping.

It is also a further object of the present invention to provide a golf bag shipping case which is constructed from a single corrugated cardboard or similar material blank.

It is another object of the present invention to provide a golf bag shipping case which allows the existing handle of a golf bag stored therein to be used to carry both the golf case and golf bag.

These and other objects of the present invention are achieved by providing a case constructed from a single corrugated cardboard blank which when folded forms a hollow elongated prism. The golf bag shipping case includes side panels connected by side fold lines to opposing sides of a central panel. In the preferred embodiment, upper and lower panels are connected at fold lines to opposing ends of the central panel and the side panels. The upper and lower panels comprise three centrally located triangular sections and side polygonal sections. The central and opposing triangular sections are substantially isosceles shaped and are connected to each other such that a base of the isosceles shaped central triangular section is connected at the fold lines to the associated ends of the central panel and bases of the opposing side triangular sections are distally located from the fold lines of the ends of the central panel. The side polygonal sections are connected to the associated side triangular sections away from the isosceles shaped central triangular section. A side flap is further connected at a side fold line to one of the side panels. It is preferable that the side flap is substantially the same shape as the side panels and the central panel and a slot in the central panel for accommodating a handle of the golf bag.

In a further embodiment of the present invention, the one of the upper or the lower panels may include a central triangular section defined by inwardly tapered fold lines which has a base connected at fold lines to the central panel. Slots are provided at the inwardly tapered fold lines and correspond to projecting tabs extending from the end of each of the side panels.

BRIEF DESCRIPTION OF THE DRAWINGS

The foregoing and other objects, aspects and advantages will be better understood from the following detailed description of the preferred embodiments of the invention with reference to the drawings, in which.

DETAILED DESCRIPTION OF THE PREFERRED

EMBODIMENTS OF THE INVENTION

For illustrative purposes only a corrugated cardboard golf carrying case will be described herein. However, it is well understood that the golf carrying case of the present invention can be made of many other materials which are capable of holding a golf bag, golf clubs and other golf equipment using the particular system described herein. It is further understood that the golf carrying case can be designed to accommodate golf bags of different dimensions, such as youth, standard and professional, and therefore that the specific dimensions of the golf carrying case, including length, width, shape and other variables and quantities specified herein may vary with the type and size of golf bag being used with the system contemplated herein. Therefore, numbers and dimensions specified herein are not to be construed as limitations on the scope of the present invention, but are meant to be merely illustrative of one particular application of the present invention.

Figure 1:
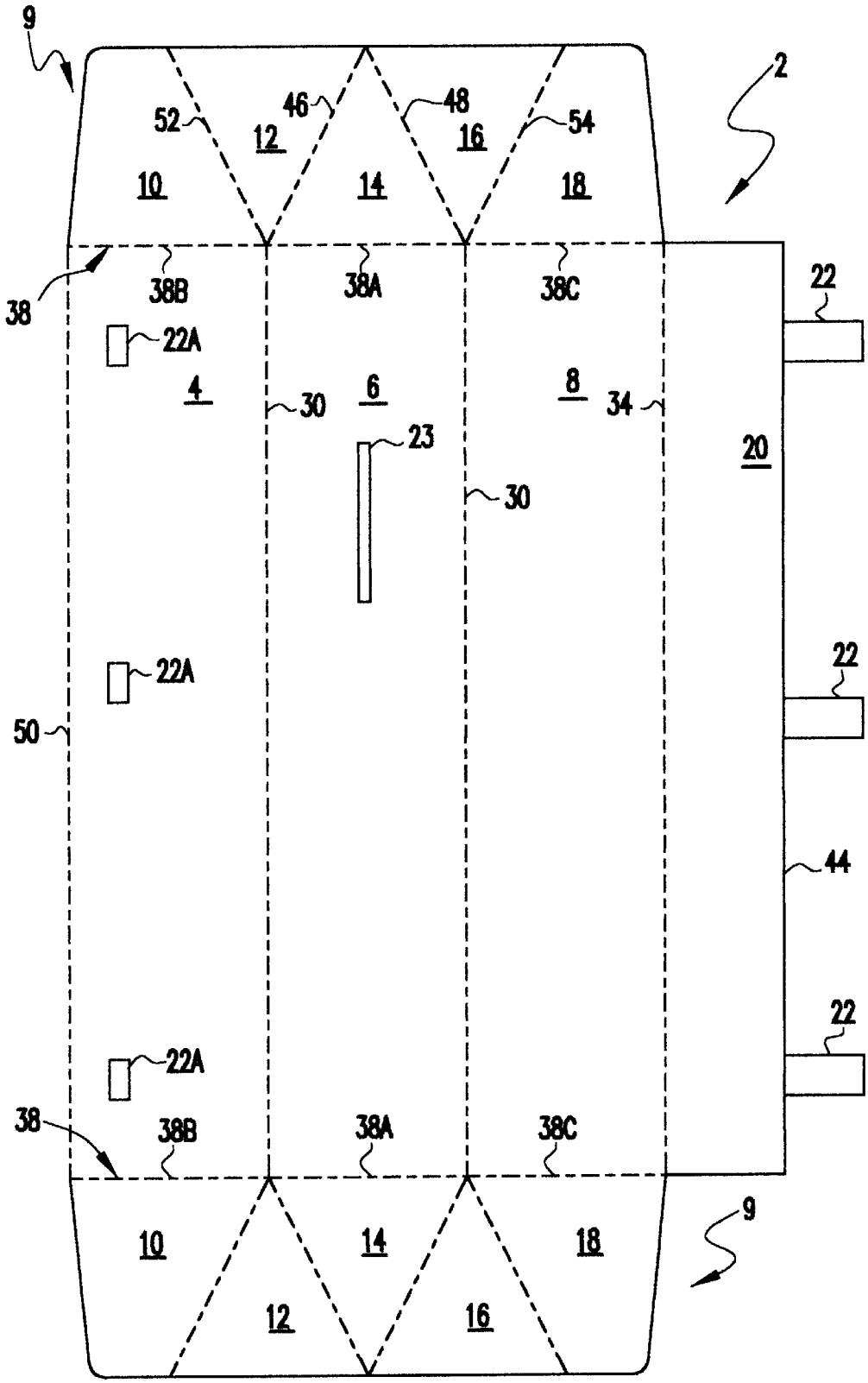
FIG. 1 is a top view of a corrugated cardboard blank with fold lines used to form a carrying case according to one embodiment of the invention.

Referring now to the drawings, and more particularly to FIG. 1, there is shown a corrugated cardboard blank 2 used for forming a carrying case for a golf bag and other golf equipment. Specifically, the corrugated cardboard blank 2 includes a centrally located panel 6 having a substantially rectangular shape. In the example illustrated, the central panel 6 has a width of approximately sixteen and one quarter inches and a length of approximately forty seven inches for a standard golf bag. However, the central panel 6 may also equally include other dimensions, again depending on the size of the golf bag to be accommodated. A slot 23 is located preferably centrally in the central panel 6 so that a handle of a golf bag can be fitted there through.

At opposing sides of the central panel 6 are side panels 4 and 8 connected to the central panel 6 at fold lines 30. The side panels 4 and 8 have substantially the same shape as the central panel 6; however, the side panels 4 and 8 may also have a larger or smaller width than the central panel 6 and more preferably have a width of approximately between sixteen and sixteen and one half inches and a length of approximately forty seven inches. Regardless of the widths of the panels 4, 6 and 8, it remains critical to the understanding of the invention that substantially the same lengths be used for all the panels 4, 6 and 8.

A side flap 20 is connected to the side panel 8 at fold line 34. Projecting tabs 22 project outwardly from an edge 44 of the side flap 20. In the preferred embodiment, there are three projecting tabs 22 which communicate with corresponding slits 22*a* located in the side panel 4 when the corrugated cardboard blank 2 is folded. The projecting tabs 22 secure the panels 4, 6 and 8 in the proper position when the corrugated cardboard blank 2 is folded to form the golf carrying case of the present invention. It is well understood by one of ordinary skill in the art that any number of projecting tabs 22 may be used with the system of the present invention. It is also well understood by one of ordinary skill in the art that the length of the side flap 20 is substantially equal to the length of the remaining panels 4, 6 and 8; however, in the preferred embodiment, the side flap 20 has a slightly smaller width than the side panels 4 over which it is folded.

Still referring to FIG. 1, upper and lower opposing flaps 9 are attached to the upper and lower ends of the panels 4, 6 and 8, respectively, at fold lines 38. For clarity purposes, only the upper opposing flap 9 will be described herein; however, it will be understood that both the upper and lower opposing flaps 9 include mirror image features and that like reference numerals are used to described like features on the upper and lower opposing flaps 9.

The upper opposing flap 9 includes five sections and has a width of approximately fourteen inches in the preferred embodiment. Specifically, a central triangular panel 14 having a base equal to the width of the central panel 6 is connected to the central panel 6 along fold line 38*a*. A side triangular panel 12 is connected to the central triangular panel 14 at mutually corresponding legs by fold line 46, and an opposing side triangular panel 16 is connected to the central triangular panel 14 at mutually corresponding legs by fold line 48. The bases of triangular panels 12 and 16 are distally located from the fold line 38. In the preferred embodiment, the triangular panels 12, 14 and 16 are substantially shaped as isosceles triangles; however, other shaped triangles may be used depending on the corresponding sizes of the panels 4, 6 and 8.

A polygon panel 10 is connected along the end portion of panel 4 at fold line 38*b*, and polygon panel 18 is connected along the end portion of side panel 8 at fold line 38*c*. The polygon panel 10 is also connected to a leg of the triangular panel 12 at fold line 52 and, similarly, the polygon panel 18 is connected to a leg of triangular panel 16 at fold line 54. In the preferred embodiment, the outer ends (e.g., the ends opposing the triangular panels 12 and 16, respectively) of the polygonal panels 10 and 18 are slightly tapered inwardly and the corners are rounded so that the ends and corners do not interfere with the remaining portions of the corrugated cardboard blank 2 during the folding process. Also, the upper and the lower flaps 9 are substantially a rectangular shape and have a length substantially equal to the width of the combined panels 4, 6 and 8.

Figure 2:
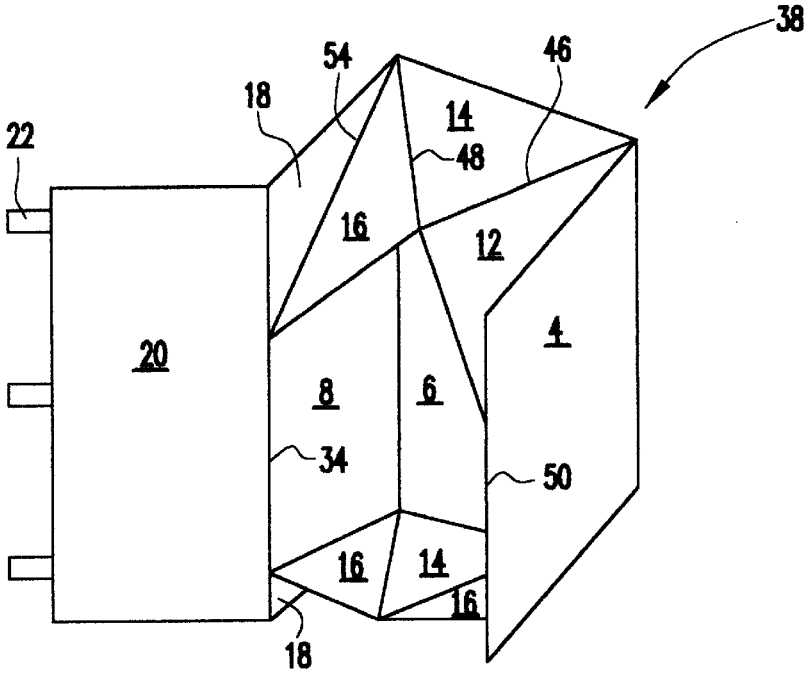
FIG. 2 is a perspective view of the corrugated cardboard blank of FIG. 1 partially folded.

FIG. 2 shows the corrugated cardboard blank 2 partially folded. In order to form the carrying case for a golf bag of the present invention, the panels 4, 6 and 8 of the corrugated cardboard blank 2 are folded along respective fold lines. Specifically, the upper and the lower opposing flaps 9 are folded inwardly toward the panels 4, 6 and 8 along fold line 38 such that the inner surface of the upper and lower opposing flaps 9 contact the inner surface of the panels 4, 6 and 8. As the side panels 4 and 8 are folded inwardly toward the central panel 6 along fold lines 30, the polygonal panels 10 and 18 remain in contact with the inner surface of the side panels 4 and 8, and the inner triangular panels 12, 14 and 16 begin to separate from the central panel 6 and portions of the side panels 4 and 8. As the side panels 4 and 6 continue to be folded inwardly, the outer surfaces of the side triangular panels 12 and 16 begin to contact the outer surface of the polygonal panels 10 and 18, respectively. At this same time, the central triangular panel 14 forms a closed flat end of the carrying case of the present invention. The side panels 4 and 8 are folded inwardly until the outer edge 50 of the side panel 4 contacts the fold line 34. After folding the side panels 4 and 8 inwardly until the outer edge 50 of the side panel 4 contacts the fold line 34, the side flap 20 can then be folded over the outside surface of the side panel 4, and the projecting tabs 22 can be fitted within the respective slits 22*a* located in the side panel 4. This will secure the panels 4, 6 and 8 of the present invention in their proper position.

In the preferred embodiment, it is desirable to pre-fold all of the panels and flaps at the respective fold lines prior to forming the carrying case of the present invention, and to glue or fix in any other known manner, the polygonal panel 18 to the respective side panel 8. The pre-folding of the panels and flaps will allow for easier assembly of the carrying case when the golf bag and other equipment is placed in the carrying case since the prefolded fold lines will now permit the respective panels to more easily adjust into their proper position.

Figure 3:
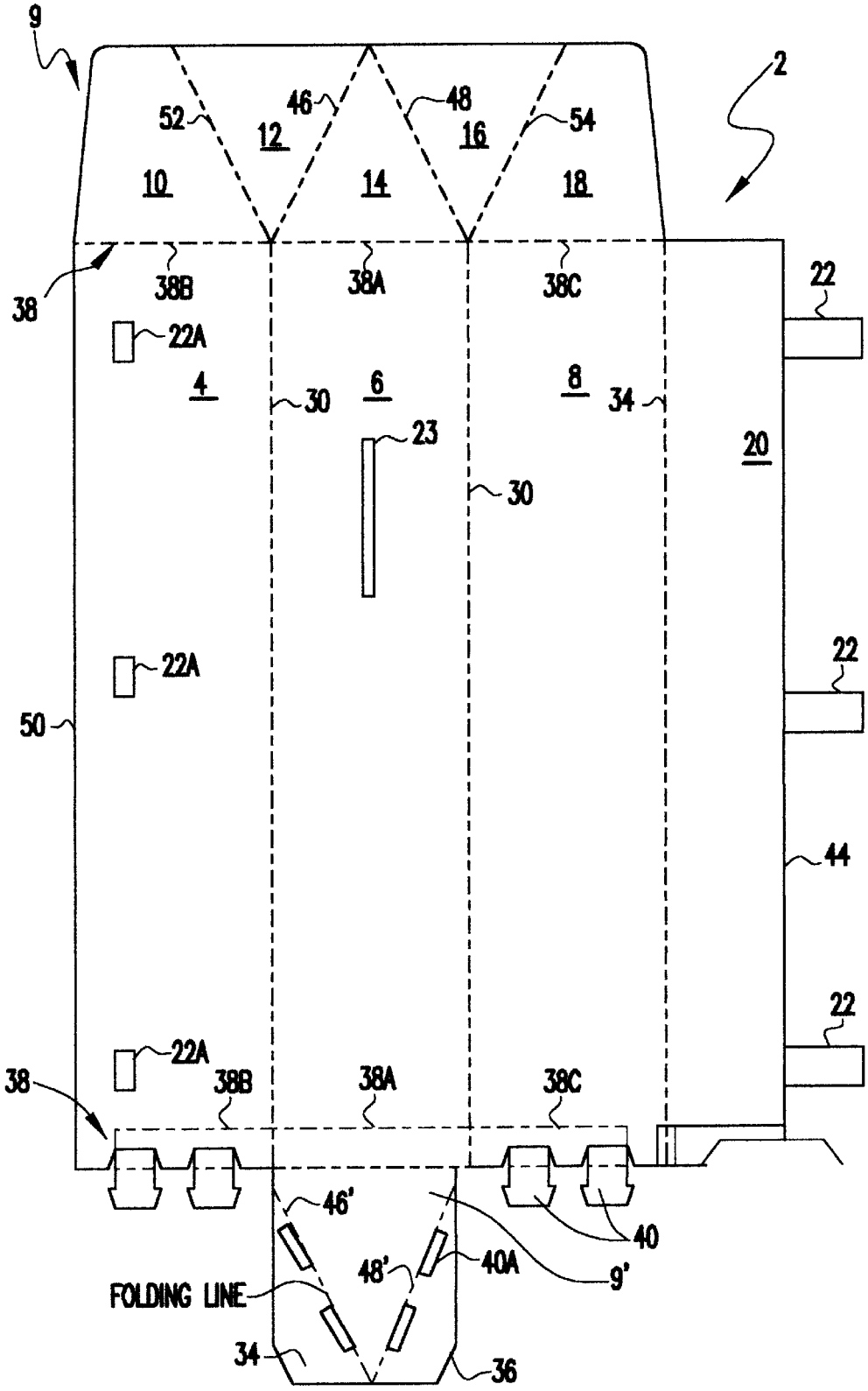
FIG. 3 is a top view of an alternative embodiment of the corrugated cardboard blank with fold lines used to form the carrying case according to the invention.

FIG. 3 shows an alternative embodiment of the blank with fold lines used to form the carrying case. FIG. 3 is substantially identical to FIG. 1, except for the lower opposing flap 9 and the ends of the side panels 4 and 8 opposing the upper opposing flap 9. Specifically, the lower opposing flap of FIG. 3 includes a flap portion 9' connected only to the central panel 6 at fold line 38*a*. The flap portion 9' includes a central triangular panel 14' having a base equal to the width of the central panel 6 and connected to the central panel 6 along the fold line 38*a*. The central triangular panel 14' is substantially identical to the central triangular panel 14 of the upper opposing flap 9 in the FIG. 1 embodiment. A side polygonal panel 34 is connected to the central triangular panel 14' along a mutually corresponding leg at fold line 46', and an opposing side polygonal panel 35 is connected to the central triangular panel 14' along a mutually corresponding leg at fold line 48'. Slits 40*a* are located on the fold lines 46' and 48' and communicate with respective projecting tabs 40 extending from the ends of the side panels 4 and 6, respectively.

Similar to FIG. 2, when the corrugated cardboard blank is folded to form the carrying case of the present invention, the central triangular panel 14' forms a closed flat end of the carrying case of the present invention. However, when the corrugated cardboard blank is folded, outer surfaces of the side polygonal panels 34 and 36 now contact inner surfaces of the side panels 4 and 6, respectively, and the projecting tabs 40 communicate with the slits 40*a* in order to secure the panels in the proper position.

Figure 4:
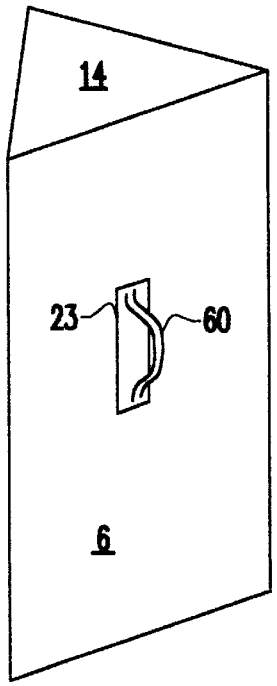
FIG. 4 is a perspective view of the blank of FIGS. 1 and 3 folded to form an elongated prism carrying case of the present invention.

FIG. 4 shows the blanks of the embodiments of FIGS. 1 and 2 in a filly folded position. As can be clearly seen from FIG. 4, by folding the corrugated cardboard blank 2 in the manner described above, an elongated prism shaped carrying case is formed. Specifically, the panels 4, 6 and 8 form the elongated sides of the elongated prism and the central triangular panels 14 form the opposing flat bases of the elongated prism. The panels 6 and 14 are shown in FIG. 4. The slot 23 in panel 6 is positioned to allow the golf bag handle 60 to protrude, providing a convenient way to carry the golf bag within the golf carrying case. The side flap 20 is folded over the outside surface of the side panel 4 and thus also forms one of the elongated sides of the elongated prism. The side flap 20 also provides further strength and durability to the carrying case since it acts as a further shield or cover for the carrying case. Due to the prism shape of the carrying case, other objects cannot now be stored on the carrying case.

While the invention has been described in terms of its preferred embodiments, those skilled in the art will recognize that the invention can be practiced with modification within the spirit and scope of the appended claims.

Having thus described our invention, what I claim as new and desire to secure by Letters Patent is as follows:

1. A golf bag shipping case, comprising:

a central panel and first and second side panels respectively connected at side fold lines to opposing sides of the central panel;

upper and lower panels connected at fold lines to opposing ends of the central panel and the first and second side panels, wherein each of the upper and lower panels includes three centrally located triangular sections and side polygonal sections, the three centrally located triangular sections including a central triangular section and first and second opposing side triangular sections, the central triangular section and first and second opposing triangular sections being substantially isosceles shaped and connected to each other such that a base of the central triangular section is connected at the fold line to the associated end of the central panel and the base of the first and second opposing side triangular sections are distally located from the fold line of the end of the central panel, and the side polygonal sections are connected to associated first and second opposing side triangular sections away from the central triangular section; and a side flap connected at a side fold line to one of the side panels, the side flap being substantially a same shape as the side panels and the central panel.

2. The golf bag shipping case of claim 1, wherein the side flap is narrower than the side panels such that when the carrying case is in a folded position, the side flap extends to approximately a center of one of the side panels.

3. The golf bag shipping case of claim 2, wherein the side flap includes at least one outwardly projecting tab for insertion into a corresponding slot in the second panel.

4. The golf bag shipping case of claim 3, wherein there are three outwardly projecting tabs on the side flap, each of the three outwardly projecting tabs being insertable into a corresponding slot in the central panel.

5. The golf bag shipping case of claim of claim 1, further wherein the central panel includes a slot through which a handle of a golf bag may protrude to allow carrying of the golf bag within the golf bag shipping case.

6. The golf bag shipping case of claim 1, wherein the central triangular section of the upper and lower panels form a flat end when the shipping case is in a folded position.

7. The golf bag shipping case of claim 1, wherein the side polygonal sections are pre-folded and glued to respective ones of the first and second side panels.

8. The golf bag shipping case of claim 1, wherein each of the upper and the lower panels is substantially a rectangular shape having a length substantially equal to the width of the first and second side panels and the central panel combined.

9. The golf bag shipping case of claim 8, wherein the side polygonal sections each have an inwardly tapered outer end with respect to the ends of the first and second side panels.

10. The golf bag shipping case of claim 9, wherein the side polygonal sections have rounded corners.

11. The golf bag shipping case of claim 10, wherein the side polygonal sections are pre-folded and one of the side polygonal sections is glued to a respective first or second side panels.

12. The golf bag shipping case of claim 1, wherein a base of each of the central triangular sections of the upper and lower panels is connected at the fold lines to the associated ends of the central panel, and the opposing first and second side triangular sections are connected at inwardly tapered fold lines with respect to the central panel.

13. A golf bag shipping case, comprising:

a central panel and first and second side panels respectively connected at side fold lines to opposing sides of the central panel;

upper and lower panels connected at fold lines to opposing ends of the central panel, wherein one of the upper and lower panels is further connected at the fold lines to the first and second side panels and includes three centrally located triangular sections and side polygonal sections, the three centrally located triangular sections including a central triangular section and first and second opposing side triangular sections, the central triangular section and first and second opposing triangular sections being substantially isosceles shaped and connected to each other such that a base of the central triangular section is connected at the fold line to the associated end of the central panel and bases of the first and second opposing side triangular sections are distally located from the fold line of the end of the central panel, and the side polygonal sections are connected to associated first and second opposing side triangular sections away from the central triangular section; and a side flap connected at a side fold line to one of the side panels, the side flap being substantially a same shape as the side panels and the central panel.

14. A golf bag shipping case: of claim 13, wherein:

another of the upper and lower panels defined as a second end flap includes a central triangular section and flap sections connected to opposing sides of the central triangular section, the central triangular section is defined by inwardly tapered fold lines and further includes a base connected by the fold line to the central panel; and projecting tabs extending from second ends of each of the first and second side panels for insertion into slots located on the inwardly tapered fold lines of the second end flap.

15. The golf bag shipping case of claim 14, wherein the side flap includes at least one outwardly projecting tab, and the central panel includes at least one slit, the at least one outwardly projecting tab of the side panel fitting into the at least one slit.

16. The golf bag shipping case of claim 14, wherein the side flap is narrower than the side panels such that when the carrying case is in a folded position, the side flap extends beyond an edge of one of the side panels.

17. The golf bag shipping case of claim 14, wherein the side polygonal sections are pre-folded and one of the side polygonal side panels is glued to respective the first or second side panels.

18. The golf bag shipping case of claim 14, wherein the one of the upper and lower panel is substantially a rectangular shape having a length substantially equal to the width of the first and second side panels and the central panel combined.

19. The golf bag shipping case of claim 18, wherein the side polygonal sections each have an inwardly tapered outer end with respect to the ends of the first and second side panels.

20. The golf bag shipping case of claim 19, wherein the side polygonal sections have rounded corners.

21. The golf bag shipping case of claim 20, wherein the side polygonal sections are pre-folded and glued to respective ones of the first and second side panels.

* * * * *